US006793199B2

(12) United States Patent
Bushik et al.

(10) Patent No.: US 6,793,199 B2
(45) Date of Patent: Sep. 21, 2004

(54) ENCASED GAS VALVE CONTROL HOUSING HAVING A PLASTIC BODY AND AN OVER-MOLDED SEAL

(75) Inventors: Dean Bushik, Buena Park, CA (US); Raymond-Paul Joubran, Pasadena, CA (US); Marius Versluis, Speyer (DE)

(73) Assignee: Robertshaw Controls Company, Long Beach, CA (US)

( * ) Notice: Subject to any disclaimer, the term of this patent is extended or adjusted under 35 U.S.C. 154(b) by 83 days.

(21) Appl. No.: 09/929,378

(22) Filed: Aug. 13, 2001

(65) Prior Publication Data

US 2003/0030024 A1 Feb. 13, 2003

(Under 37 CFR 1.47)

(51) Int. Cl.[7] ..... F16K 1/00
(52) U.S. Cl. ..... 251/367; 251/368
(58) Field of Search ..... 251/367, 368; 137/884

(56) References Cited

U.S. PATENT DOCUMENTS 3,602,246 A * 8/1971 Hettinger et al. ..... 137/884
3,647,179 A * 3/1972 Scaramucci et al. ..... 251/367
3,677,514 A * 7/1972 Mencarelli ..... 251/367
3,683,960 A * 8/1972 Kirsch ..... 137/594
3,688,797 A 9/1972 Sorenson
4,168,724 A * 9/1979 Graffunder et al. ..... 137/884
4,993,684 A 2/1991 Prina
5,076,542 A * 12/1991 Ottens et al. ..... 251/367
5,242,570 A * 9/1993 Roodnat ..... 205/128
5,417,245 A * 5/1995 King et al. ..... 251/367
5,533,543 A * 7/1996 Semeia ..... 251/359
5,651,555 A * 7/1997 O'Reilly et al. ..... 137/625.21
6,019,120 A * 2/2000 Najmolhoda et al. .. 251/129.14
6,076,551 A * 6/2000 Miyazoe ..... 137/884
6,192,912 B1 2/2001 Butler et al.
6,276,392 B1 * 8/2001 Hendrickson ..... 137/271

FOREIGN PATENT DOCUMENTS

GB 1424855 A 2/1976

* cited by examiner

*Primary Examiner*—John Bastianelli
(74) *Attorney, Agent, or Firm*—Blackwell Sanders Peper Martin LLP

(57) ABSTRACT

This invention is directed to improvements in valve control housings, specifically those used in the consumer, commercial, and industrial markets to house gas control valves. The present invention includes a plastic body, the body being molded to accept valve components, an integral sealant being over-molded to the plastic body, and a case, the plastic body being sealingly surrounded by an outer case.

19 Claims, 4 Drawing Sheets

ENCASED GAS VALVE CONTROL HOUSING HAVING A PLASTIC BODY AND AN OVER-MOLDED SEAL

FIELD OF THE INVENTION

This invention relates to novel gas valve control housings for use in the consumer, commercial, and industrial product markets.

DESCRIPTION OF THE PRIOR ART

Long known for controlling gas flow, gas valves have been in use for decades to control flow of a variety of gaseous fuels for appliance products. Such valves are used to regulate flow and pressure of natural gas and propane, for example, in residential consumer appliances such as central heating units, space heaters, wall heaters, water heaters, boilers, stoves, and outdoor grills. Additionally, gas control valves are widely used in commercial and industrial applications.

Gas valves operate to regulate the flow of gas from a pressurized source to, for example, a downstream gas burner. Simplistic gas valves may provide only manually operated open and closed functions. More sophisticated gas valves, however, may include additional regulation features such as low, medium, and high flow stops and may include thermostatically controlled servo motor actuation, inlet and outlet screens, and bleed gas and pilot filters.

To adequately control gas at a variety of incoming pressures, modern gas valves require a number of components to become effectively and conveniently operational. Gas valve assemblies at a minimum usually require a valve stem, a valve guide, a valve seat, an actuator rod, an actuator knob, an inlet means to connect to the gas supply, and an outlet means to connect to the burner. Such assemblies may also employ gas tubing for a pilot, and pressure sensing diaphragms, magnetic structures, and servo-actuators to thermostatically control the valve.

Typically, a valve assembly is packaged in a housing to contain and support the discrete components of the assembly and to provide a structural fixture from which the valve can be mounted to the appliance. Valve assembly housings have been configured for these purposes and are frequently formed from metal alloys. Aluminum and stainless steel have been materials of choice for such control housings.

The metal housing is often cast to form two mating parts and is subsequently machined to provide precision orifices and other intricate features such as seats for press fitting of the valve components. Gas transport passageways between components are also precision machined into one or more of the housing parts. Gaskets are configured between the mating surfaces of the housing parts before they are joined to prevent gas leakage after assembly. Gasket material is also used to seal component parts to the housing.

The metal housings of the prior art are typically cast from dies. Such metal cast housings, frequently composed of aluminum, may be gas permeable, the composition of the cast part being somewhat porous. As is frequently the case, the inside of the valve assembly housing is pressurized from the gas source creating a pressure differential between the inside and outside of the housing. The porous cast metal housing wall and/or incomplete sealing of mating surfaces may form pathways for undesirable leakage.

Control valve housings are often subject to consumer environmental requirements such as AGA, CGA, and Underwriters Laboratories (UL). Valve assemblies may, for example, be subject to temperature ratings of between −40 degrees Fahrenheit to +175 degrees Fahrenheit.

Temperature-induced expansion and contraction of the porous cast metal may also cause a pressure differential to form, further facilitating undesirable transmission of the gas through the porous housing wall and/or through pathways formed by incomplete sealing of housing and component parts.

One method to streamline manufacturing of valve assemblies, has been to adopt a single valve assembly housing to accept a variety of valve components. In this fashion, a variety of valve models from the simplistic to the complex can utilize the same cast housing parts. Press-fit orifices and gas flow passageways can be machined and changed as needed depending upon the configuration of the valve assembly to be inserted. To accommodate a simple valve assembly, for example, only a small number of press-fit orifices and gas transport passageways are required to be machined. To produce a more complicated valve assembly, additional machining to the housing may be required to provide for the extra components and to provide functional communication, such as gas transport passageways, therebetween.

Varying processes to construct a product line from a single metal housing configuration can be costly as each housing must be machined to suit a particular model and its particular componentry. Shifting from one machining procedure to another requires manufacturing set-up adjustments thereby adding time and expense to modify each housing. Additionally, the handling of non-uniform parts, due to changes in manufacturing procedures from one model to the next, may serve to increase the likelihood of error by operators of the machining tools producing the specialized housings.

Another way in the prior art to provide reduced-cost manufacturing of valve control assemblies has been to create a standardized housing that accommodates components of a variety of valve models. The housing is formed to accommodate the most complicated assembly contemplated for the housing, and is machined in the same fashion for all models. Models not requiring all the componentry of the most sophisticated design may be configured with dummy non-functioning components. Alternatively, undesired components and their facsimiles may be omitted altogether depending on the configuration. However, the unnecessary machining required of the housing for simplified models and dummy parts is costly and wasteful. Utilizing this approach, valve controls of basic design are packaged in housings that may be of unnecessarily excessive size, weight, and cost.

Cast metal housings of the prior art suffer from additional cost disadvantages. During the molding process, dies that form metal parts frequently wear relatively rapidly. Increased wear of a die diminishes the number of dimensionally conforming parts produced from that die. Yielding fewer conforming parts, the costly die must be replaced frequently. Furthermore, the weight of the cast metal housing is typically relatively heavy resulting in increased transportation costs to ship the valve control, whether in unfinished or in fully assembled form.

Competition in the valve control markets is substantial. Lowering costs of production in the valve control industry, whether it be in materials, numbers of parts, processing, or otherwise is actively sought out by manufacturers to provide themselves with a competitive advantage. Such advantage may take the form of lowered costs which translate into increased market share, and, ultimately result in increased return on investment.

As valve control assemblies often require a substantial number of discrete parts, cost disadvantages to the manufacturer can quickly multiply. To produce a product line of control valves often requires stocking, compiling, and assembling large numbers of parts increasing numbers of discrete parts also provides for increased opportunities for error, manufacturing time lost, material scrap, and increased product returns.

What is needed is a valve control housing that is lightweight, does not leak, requires less time to manufacture, and is economical to produce and transport. The present invention fulfills this need.

SUMMARY OF THE INVENTION

This invention is directed to an improvement in valve control housings, specifically those used in the consumer, commercial, and industrial markets to house gas control valves. The present invention includes a plastic molded body sealingly surrounded by an outer metal case. The plastic body is molded to accept valve components and includes necessary gas transport passageways and an integral over-molded rubber sealant. The outer metal case is formed from an extruded metal tube capped at each end by a metal plate.

The molded plastic body is modular in design so as to provide for varying functional components, and has an over-molded rubber seal integral to it for sealing against the metal case so as to prevent undesirable leakage of gas. The plastic body fits into the extruded metal tube and is secured at the top and bottom by metal plates.

The present invention includes a plastic body molded in a fashion so as to accept valve components necessary for operation of the particular valve model. A variety of plastic body configurations may be produced by utilizing various modular injection molds or, alternatively, produced from a single mold encompassing an entire body.

While varying internally, depending on the model, the exterior dimensions of the plastic body is formed to be sealingly encapsulated by the metal case. An integral rubber seal is molded over the plastic body to help prevent gas from undesirably leaking into the exterior environment. By varying the internal configuration of the plastic body via selection of injection mold, the problem of high costs associated with casting and individually machining metal housing is eliminated. In addition, the present invention possesses a number of advantages over prior art configurations used throughout the gas control valve industry.

One advantage of the present invention is the modularity of the plastic body. Many different body configurations can be produced in the plastic body to fit in the same extruded metal casing, providing many different functions including, but not limited to, direct opening, intermittent pilot, provisions for side outlets, non-regulated configurations, etc. The present invention reduces the cost of producing many different models in a single product line of controls.

Many changes to the operability of the valve controls can be made in the mold for the plastic body without requiring changes in the assembly or the pieces used for the assembly of a particular operation outside the control housing. Additionally, certain components can be eliminated by incorporating them into the plastic body such as valve seats and seals. Reduced componentry provides for simplified assembly and fewer rejected parts due, for example, to out of order installation. Many internal chambers and passages as well as additional components are provided for by way of differing molds for the plastic body. Thus, a base model housing may not require additional complexity to provide for alternate versions of the control. More sophisticated valve control assemblies may be provided in a plastic body of the same external dimensions so as to fit within the metal casing.

Another advantage of the present invention occurs in the extended life of the die used to mold the plastic body. This advantage is found in the comparative cost, wear, and useful life of utilizing plastic instead of metal injection molds. Plastic components produced through injection molding are less costly than the same configuration as produced in a metal die due to the extra wear caused to the die by the injection of metal during the molding process. The tooling necessary for the plastic injection also lasts longer than similar equipment used for metal parts and produces more dimensionally accurate parts over a longer period of time.

Still another advantage of the present invention is that little or no machining is required in the plastic body. In the prior art, precision orifices and many other intricate features must be machined into a metal casting for the production of a gas control. A plastic body may be molded into the desired configuration out of the mold with the required dimensional attributes for operability with little, if any, need to finish the body by way of machining. The present invention may eliminate the costly machining step in production of the valve control housing.

A further advantage of the present invention is the reduction in the number of parts required to produce the valve control. Many small internal components that previously would be assembled into a machined metal body with press fits can be integrated directly into the plastic body. The over-molded rubber seal on the plastic body, for example, can be integral to the plastic body, and can be formed in the same mold. Alternatively, a discrete seal may be utilized. The over-molded rubber seals should eliminate the use of gaskets. Valve stems, pressed-in orifice spuds, and valve seats and seals may also be integrated into the plastic body. Such integral components may be formed in the plastic body mold, sonically welded in, and/or over-molded to the plastic body.

A further advantage of the present invention is the reduced weight of the housing which is provided in large measure by the plastic body. Cast aluminum parts, for example, are substantially heavier than plastic injected parts of the same volume. A lighter weight control does not require as much mounting hardware as a heavier control, further reducing the weight of the end product. Lower weight translates into further reduced transportation costs and product costs.

Another advantage of the present invention is the elimination of the metal cast housing. The use of the extruded metal tube eliminates most of the inherent problems of porosity and potential leakage associated with cast metal parts. Use of the plastic body and over-molded rubber seal for the internal valve seats and gas passages should also reduce or eliminate the need for gaskets.

Other features and advantages of the invention will become apparent from the following detailed description, taken in conjunction with the accompanying drawings, which illustrate, by way of example, the features of the invention.

DETAILED DESCRIPTION OF PREFERRED EMBODIMENTS

Figure 1A:
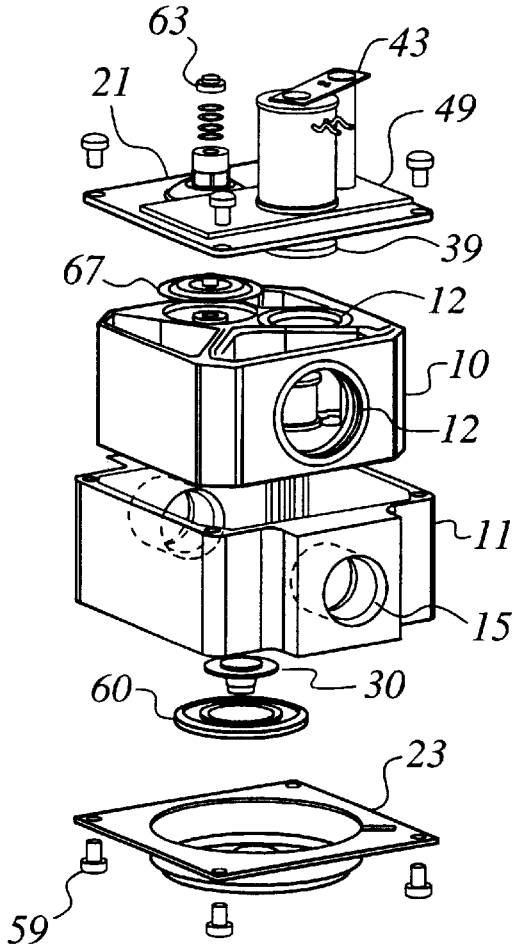
FIG. 1*a* is an exploded perspective view of a gas valve control incorporating the present invention.

Generally, the preferred embodiment of the invention as shown in FIG. 1*a* consists of a gas control valve housing comprising a plastic molded body 10, an extruded metal tube 11, a metal top plate 21 and a metal bottom plate 23. The plastic body also includes an over-molded sealant 12 positioned to seal the body to the housing to prevent undesirable gas leakage.

Figure 2:
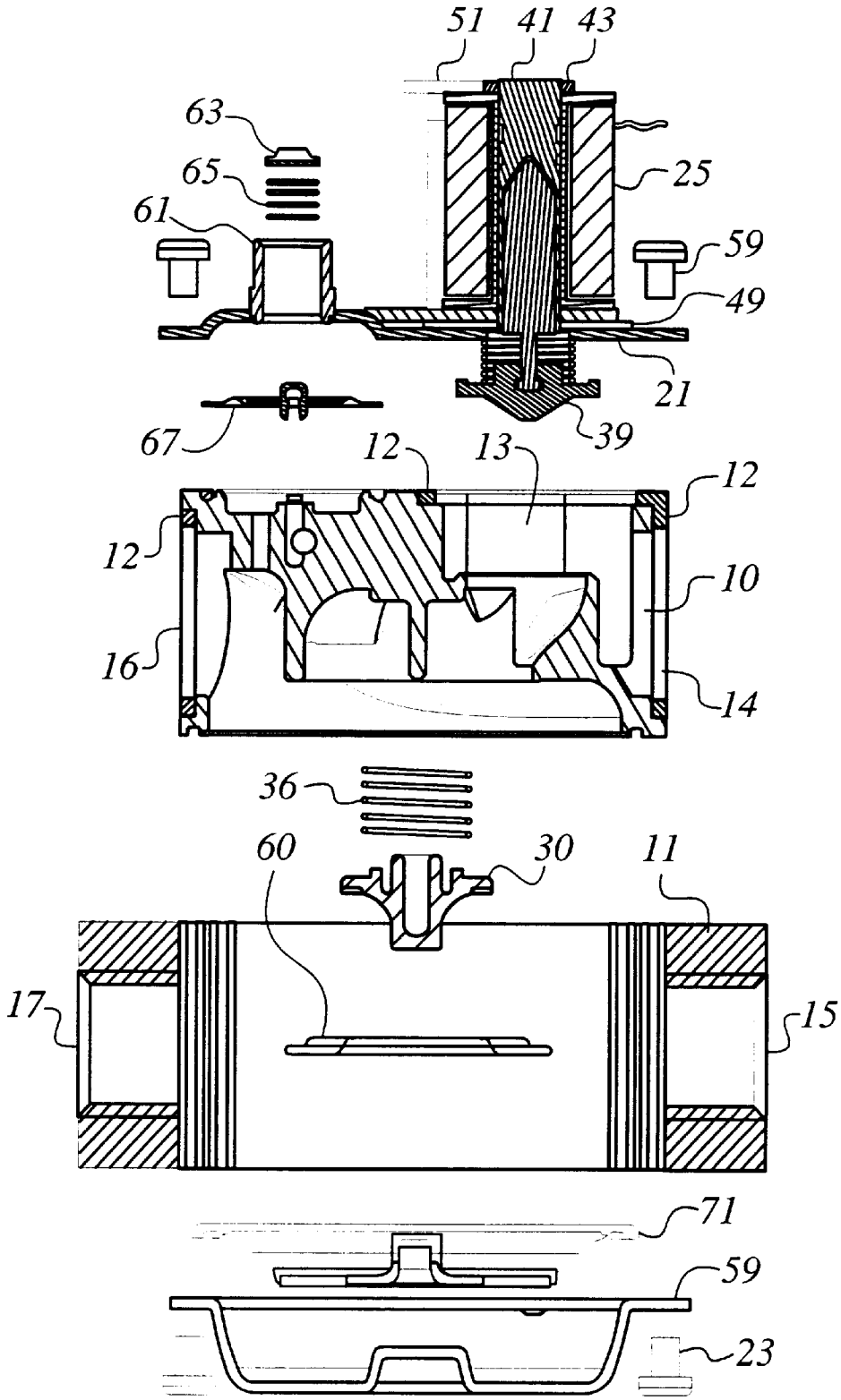
FIG. 2 is an exploded cutaway side view taken along section A—A of FIG. 1*b;*

The molded body shown in FIG. 2 is formed with a gas inlet port 14, a gas outlet port 16, and at least one cavity 13. The cavity is configured to accept at least one valve component for controlling gas transmission. The molded body 10 can be formed of plastic comprising, for example, 6-6 30% glass-filled nylon, NORYL®®1 GTX, and/or VALOX®. NORYL® is a synthetic thermoplastic resin for molding and extrusion purposes manufactured by the General Electric Company, haying a place of business at Noryl Avenue, Selkirk, N.Y. 12158. VALOX® is a thermoplastic resin for molding and extrusion purposes manufactured by the General Electric Company, having a place of business at 3135 Easton Turnpike, Fairfield, Conn. 06431.

Figure 3:
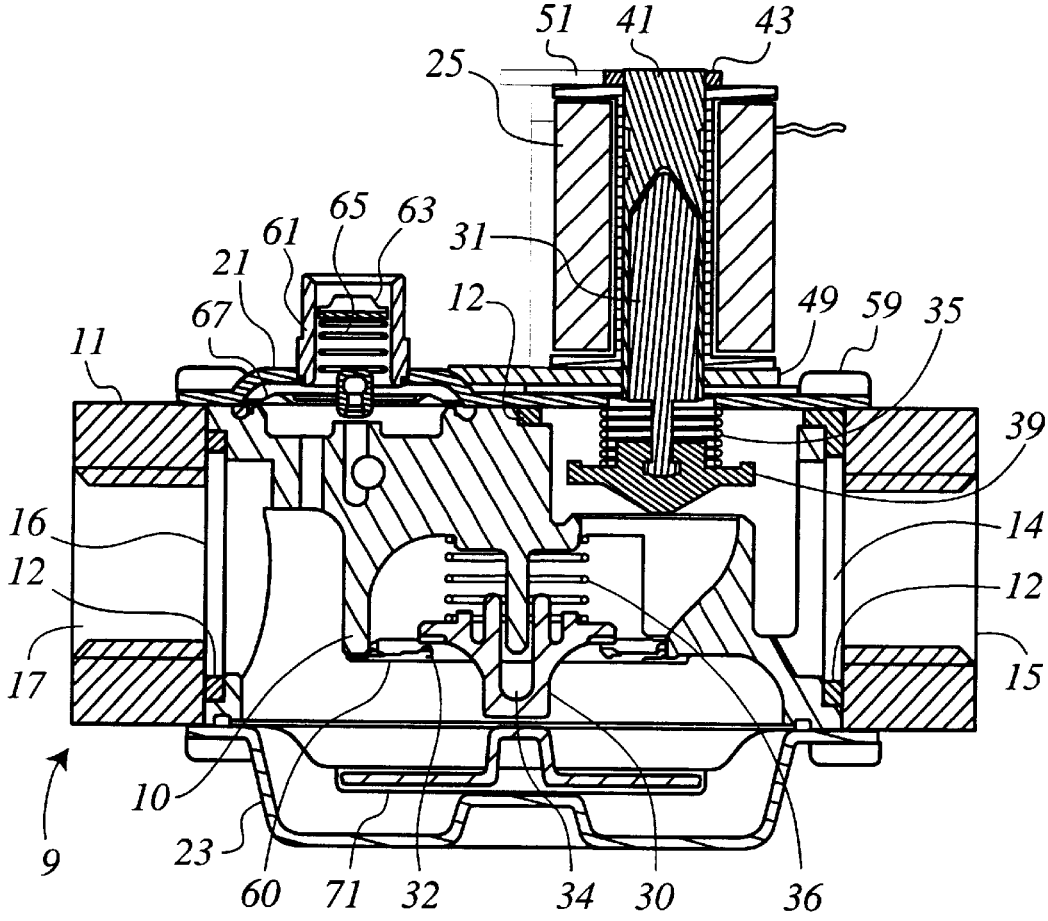
FIG. 3 is a cutaway side view taken along section A—A of FIG. 1*b*.

In the assembled state of the control shown in FIG. 3, the inlet opening 15 is substantially gas transmissably and axially aligned with the gas inlet port 14 and the outlet opening 17 is substantially gas transmissably and axially aligned with the gas outlet port 16 of the molded body 10.

The extruded tube 11 surrounding the molded body 10, is machined with an inlet opening 15 and an outlet opening 17. Together with top plate 21 and bottom plate 23 the extruded tube 11 forms the metal casing 9. The molded body 10 inserts into the tube and seals at the opening inlet 15 and outlet opening 17 with sealant 12. The interior surfaces of the tube provide sealing surfaces and are sized to provide the proper compression for the sealant. The tube is extruded from 6061-T6 aluminum also, but may be formed from a variety of other metals.

The over-molded sealant 12 is positioned between the molded body 10 and the casing 9 formed from the extruded tube 11 and the two plates 21 and 23 so as to prevent undesirable transmission of gas through the housing.

The sealant is an integral part of the molded body and is shot directly onto the molded body 10 in production and adheres through a combination of mechanical and chemical bonding, as is known in the art, directly to the molded body. The sealant eliminates the need for a gasket, and provides a seal against the extruded tube 11 at the inlet opening 15 and outlet opening 17 of the control, and against the top plate 21. The sealant is made from a silicon rubber compound or from other sealant material known to those in the art.

Also, integral to the molded body 10, is a first solenoid valve seat 57, a second solenoid valve seat 58, a main valve seat 60, a main valve stem 34, and a cavity 13 to provide the passageway for the gas through the valve control.

Figure 4:
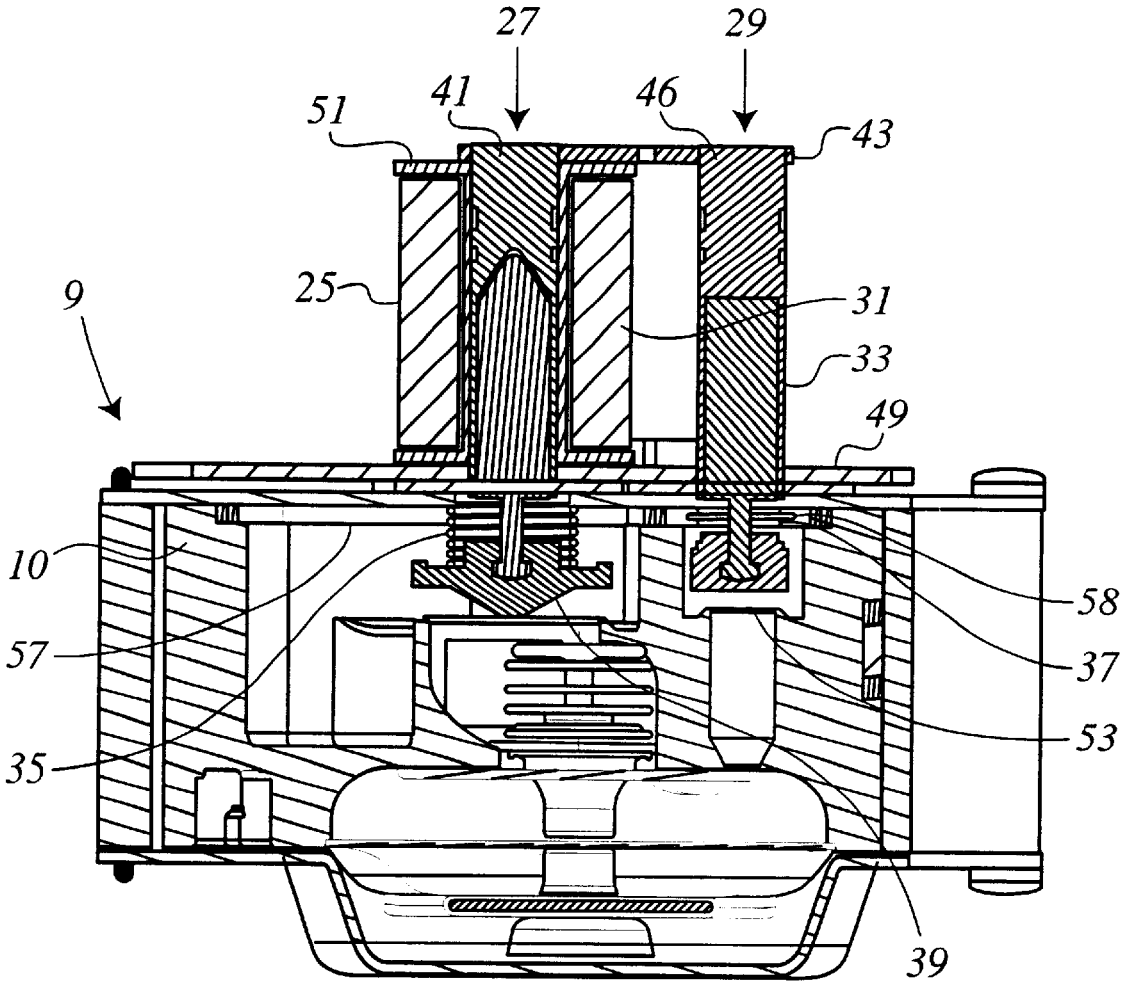
FIG. 4 is a cutaway side view taken along section X–X of FIG. 1*b*.

In FIGS. 3 and 4, the top cover plate 21 is fastened to the extruded tube 11 and into sealing engagement with sealant 12 via fasteners 59. Top plate 21 also provides a substrate for attachment of component parts of the valve control. In the present embodiment, the first solenoid valve 27, the second solenoid valve 29 and the regulator tower 61 mount on the top cover plate. The top plate is stamped from 1008–1010 alum killed steel, #1F, #5T coiled, however, other metals and forming methods may be used as in known in the art.

The bottom plate 23 is fastened to the extruded tube 11 with fasteners 59. The bottom plate is formed to set in sealing engagement with the main diaphragm 71. As is known in the art, the main diaphragm is pressurized to create lift in the main valve 30. The bottom plate is stamped from 1008–1010 alum killed steel, #1F, #5T coiled, however, other metals and forming methods may be used as in known in the art.

Figure 1B:
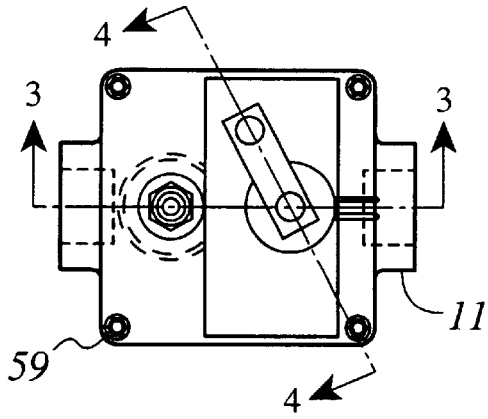
FIG. 1*b* is a top view of a gas valve control incorporating the present invention.

The fasteners 59 shown in FIG. 1 fasten the top plate 21 and the bottom plate 23 to the tube 11. The fasteners allow the covers to capture the molded body 10 and compress the sealant 12, creating a seal to substantially prevent leakage of gas to the atmosphere from other than through the inlet opening 15 or outlet opening 17.

The inlet opening 15 is the site on the extruded tube 11 for gas entering into the housing. The inlet opening is threaded to accept a pipe which carries the gas to the control. The outlet opening 17 is the site on the extruded tube that the regulated gas leaves the control. The outlet opening is threaded to accept a pipe which carries the regulated gas away from the control.

Outlet gas pressure is regulated by distance between the main valve seat 60 and the main valve face 32. The main valve seat is sonic welded into the molded body 10. The sonic weld allows for the elimination of fasteners and also provides a seal that eliminates an o-ring at that location. The main valve seat is made of the same material as the molded body insert for weld compatibility.

The main valve face 32 provides a seal against the main valve seat 60 when closed with the help of the main valve spring 36. When acted on by the main diaphragm 71, the lift between the main valve seat and the main valve face create a pressure drop as the gas flows through the restricted opening, determining the outlet gas pressure. The main valve face is an over-molded piece made from a 6–6 30% glass-filled nylon core and a silicon rubber compound seal.

The main valve spring 36 exerts sufficient force to make the seal between the main valve face 32 and the main valve seat 60, and also to resist the action of the main diaphragm 71 on the main valve face. The main valve spring is made of stainless steel spring wire.

The main diaphragm 71 mechanically controls the lift of the main valve 30. When pressure is diverted under the main diaphragm by the regulator diaphragm 67, the main diaphragm lifts and physically acts on the main valve face 32 overcoming the force from the main valve spring 36 and lifting it off of the main valve seat 60. The main diaphragm is an over-molded piece made from a 6-6 30% glass-filled nylon core and a silicon rubber compound convolute membrane.

The coil 25 shown in FIG. 4 is comprised of wound copper wire. The wire that makes up the coil 25 is wound around solenoid coil bobbin 51. The bobbin provides the mechanical structure for the coil. The coil bobbin is made of nylon 6-6 30% glass filled, or equivalent material. When a call for heat is made to the first solenoid valve 27 and the second solenoid valve 29 in the form of an electrical power supply, the solenoid activates and pulls in the first plunger 31 and the second plunger 33. The coil overcomes the forces due to the pressure of the inlet gas and from the first valve spring 35 and the second valve spring 37, and lifts the respective first valve face 39 and the second valve face 53 to actuate the solenoid valves 27 to 29 and allow the flow of gas.

The solenoid valve springs 35 and 37 provide the pre-load required for sealing between the solenoid valve faces 39 and 53 and the solenoid valve seats 57 and 58 respectively in the molded body 10. The solenoid valve springs 35 and 37 are made of stainless steel spring wire.

Solenoid pole pieces 41 and 45 act as part of a magnetic flux path that pulls in the plungers 31 and 33. The pole pieces are machined from silicon (2.5%) core iron rod, annealed, carpenter B-FM core iron or equivalent material.

Upper flux plate 43 acts as part of the magnetic flux path for the solenoid valves 27 and 29. The magnetic flux that develops the force that pulls in the plungers 31 and 33 must have a complete circuit. The upper flux plate acts as the bridge for the flux as it travels from one solenoid valve to the other. The upper flux plate is made of 1008–1010 steel #5T, #1F, #3E, or equivalent material.

Lower flux plate 49 acts as part of the magnetic flux path for the solenoid valves. The magnetic flux that develops the force that pulls in the plungers 31 and 33 must have a complete circuit. Like the upper flux plate 43, the lower flux plate acts as the bridge for the flux as it travels from one solenoid valve to the other. The lower flux plate is made of 1008–1010 steel #5T, #1F, #3E, or equivalent material. The complete circuit for the magnetic flux that develops the force required to pull in the plunger travels in the following sequence: first plunger 31, first pole piece 41, upper flux plate 43, second pole piece 45, second plunger 33, and lower flux plate 49.

Solenoid valve plungers 31 and 33 are pulled in by the coil 25 to lift the valve faces 39 and 53 off of the valve seats 57 and 58. This allows for the actuation of the valve and the flow of gas. The magnetic flux produced by the coil travels through the plungers and develops a force that pulls the plunger in striving to close the gap between the plungers 31 and 33 and the pole pieces 41 and 45. The plungers are machined from silicon (2.5%) core iron rod, annealed, carpenter B-FM core iron or equivalent material.

The solenoid valve faces 39 and 53 are mechanically attached to the plungers 31 and 33 and provide a seal for the valves against the molded body 10. The force of the valve springs 35 and 37 pushes the valve faces closed against the valve seats 57 and 58 in the molded body to create a seal. The valve seats are made of a silicone rubber compound.

The regulator tower 61 is staked on to the top cover plate 21 and provides a threaded column for threaded engagement with the regulator adjustment screw 63. The regulator tower is machined from 2011-T3 aluminum alloy rod.

The regulator adjustment screw 63 has male threads on the exterior that mates with female threads on the inner diameter of the regulator tower 61. The screw is adjusted up or down along the tower to decrease or increase the compression of the regulator spring 65. This changes the regulator setting by changing the force on the regulator diaphragm 67. The regulator adjustment screw is made from 6–6 30% glass filled nylon or equivalent material.

The regulator spring 65 provides a biasing force on the regulator diaphragm 67 to set the control pressure. The regulator adjustment screw 63 sets the compression for the regulator spring. The regulator spring is made of stainless steel spring wire.

The regulator diaphragm 67 senses the outlet gas pressure and based on the amount of biasing force from the regulator spring 65 acts as a servo valve to increase or decrease the outlet pressure by controlling the flow of gas to the chamber under the main diaphragm 71. When the outlet pressure is sensed as low, the diaphragm pressurizes the area under the main diaphragm to increase the lift on the main valve 30. When the pressure is sensed as high, the diaphragm acts to decrease this lift. The regulator diaphragm is made from a silicon rubber compound.

While the invention has been described and illustrated in detail, it is to be understood that the present embodiment is to be taken by way of illustration and example only and not by way of limitation, the spirit and scope of the invention being limited only by terms of the following claims and that various changes and improvements may also be made to the invention without departing from its scope.

What is claimed is:

1. A gas control valve housing comprising:

a body formed with a gas inlet port, a gas outlet port, and at least one cavity gas transmissibly connected therebetween, the at least one cavity configured to accept at least one valve component for controlling gas transmission;

a casing having an inlet opening and an outlet opening, wherein the casing surrounds the body and wherein the inlet opening is substantially gas transmissibly aligned with the gas inlet port and the outlet opening is substantially gas transmissibly aligned with the gas outlet port; and a sealant, the sealant being over-molded and positioned between the body and the casing including between the inlet port and the inlet opening and between the outlet port and the outlet opening.

2. The gas control valve housing of claim 1, wherein the casing is formed of metal.

3. The gas control valve housing of claim 1, wherein the casing includes a tube, a top plate and a bottom plate.

4. The gas control valve housing of claim 3, wherein the tube is extruded.

5. The gas control valve housing of claim 1, wherein the body is formed of molded plastic.

6. The gas control valve housing of claim 1, wherein the sealant is integral to the body.

7. The gas control valve housing of claim 6, wherein the sealant is over-molded to the body.

8. The gas control valve housing of claim 1, wherein the sealant is rubber.

9. The gas control valve housing of claim 5, wherein the body is U formed with a valve seat.

10. The gas control valve housing of claim 9, wherein the valve seat is sonically welded to the body.

11. The gas control valve housing of claim 1, wherein the body is modular.

12. The gas control valve housing of claim 5, wherein the plastic includes 6-6 30% glass-filled nylon.

13. The gas control valve housing of claim 5, wherein the plastic includes modified polyphenylene oxide and polyphenylene ether.

14. The gas control valve housing of claim 5, wherein the plastic includes thermoplastic resin based on polybutylene terephthalate polymers.

15. The gas control valve housing of claim 3, wherein the top plate and the bottom plate is stamped from 1008–1010 alum killed steel, #1F, #5T coiled.

16. The gas control valve housing of claim 1, wherein the inlet port is axially aligned with the inlet opening.

17. The gas control valve housing of claim 1, wherein the outlet port is axially aligned with the outlet opening.

18. A gas control valve housing comprising:

a plastic body formed with a gas inlet port, a gas outlet port, and at least one cavity gas transmissibly connected therebetween, the at least one cavity configured to accept at least one valve component for controlling gas transmission;

a metal casing, the casing being formed from an extruded metal tube, a metal top plate and a metal bottom plate, the extruded tube having an inlet opening and an outlet opening, wherein the casing surrounds the body and wherein the inlet opening is substantially gas transmissibly and axially aligned with the gas inlet port and the outlet opening is substantially gas transmissibly and axially aligned with the gas outlet port; and a sealant, the sealant being over-molded to the plastic body and positioned between the body and the casing including between the inlet port and the inlet opening and between the outlet port and the outlet opening.

19. A gas control valve housing comprising:

a plastic body formed with a gas inlet port, a gas outlet port, and at least one cavity gas transmissibly connected therebetween, the at least one cavity configured to accept at least one valve component for controlling gas transmission, and a valve seat to accept a face of the valve component;

a metal casing, the casing being formed from an extruded metal tube, a metal top plate and a metal bottom plate, the extruded tube having an inlet opening and an outlet opening, wherein the casing surrounds the body and wherein the inlet opening is substantially gas transmissibly and axially aligned with the gas inlet port and the outlet opening is substantially gas transmissibly and axially aligned with the gas outlet port; and a sealant, the sealant being over-molded to the plastic body and positioned between the body and the casing including between the inlet port and the inlet opening and between the outlet port and the outlet opening.

* * * * *